United States Patent [19]

Ehrhardt

[11] 4,332,063

[45] Jun. 1, 1982

[54] FABRIC SINGER BURNER AND MANIFOLD ASSEMBLY

[75] Inventor: Henry S. Ehrhardt, Clemson, S.C.

[73] Assignee: Industrial Heat Engineering, Mauldin, S.C.

[21] Appl. No.: 194,562

[22] Filed: Oct. 6, 1980

[51] Int. Cl.[3] ..... D06C 9/02

[52] U.S. Cl. ..... 26/3

[58] Field of Search ..... 26/3; 28/174, 239

[56] References Cited

U.S. PATENT DOCUMENTS 1,862,960 6/1932 Kemp ..... 26/3
3,134,158 5/1964 Marks, Jr. ..... 26/3

FOREIGN PATENT DOCUMENTS 1677 of 1858 United Kingdom ..... 26/3
2221 of 1860 United Kingdom ..... 26/3
1528 of 1861 United Kingdom ..... 26/3
3168 of 1899 United Kingdom ..... 26/3

*Primary Examiner*—Robert Mackey
*Attorney, Agent, or Firm*—Bailey & Hardaway

[57] ABSTRACT

An improved burner and manifold assembly for improving the appearance of fabrics is illustrated wherein a tubular cast iron burner of standard construction is provided with a tubular fuel supply manifold constructed from a material possessing a coefficient of expansion resulting in expansion substantially compatible with the coefficient of expansion of cast iron and obtaining temperatures so as to reduce the tendency of these elements to bow during operation of the singer. A number of intermediately spaced pass-through connectors are provided for providing a more even distribution of heat between the burner and manifold elements of the assembly, as well as providing more even fuel distribution, as well as increased rigidity and more uniform stress distribution through bracing.

3 Claims, 5 Drawing Figures

FABRIC SINGER BURNER AND MANIFOLD ASSEMBLY

BACKGROUND OF THE INVENTION

Limitations have been placed upon singers because of the heat differential which occurs between the burner and manifold resulting in differences in expansion between the burner and manifold during operation. Since the manifold is more remote from the flame than the burner, the temperature of the manifold is not nearly so elevated as is the temperature of the burner. These members have heretofore been constructed of similar materials such as cast iron and the like. The excessive bowing which occurs as a result of differences in expansion at different elevated temperatures and when relatively long singers are involved causes damage to the machine necessitating the employment of rugged reinforcing elements such as railroad ties, in an effort to avoid bowing through longitudinal bracing.

Accordingly, it is an important object of this invention to provide an improved burner and manifold assembly to accommodate greater machine widths without excessive deformation due to heat differential between the burner and manifold.

Another important object of the invention is to provide an improved burner and manifold assembly which will avoid bowing and avoid the necessity for bracing through the use of long members aligned with the burner and manifold.

Another important object of the invention is to provide uniform singeing resulting in improved appearance of fabrics whether natural or synthetic, while controlling pilling without fiber degradation through the more nearly uniform application of flame to a fabric having the interstices open by passing about a cool roll.

Another important object of the invention is to provide a burner and manifold assembly with spaced intermediate pass-through members providing an integral assembly wherein stresses are evenly distributed between the members for providing a cross bracing and more nearly even fuel distribution to provide a uniform flame which is fed for impingement upon the fabric from a more nearly aligned and evenly spaced burner.

The invention hereof is an improvement upon singers such as those illustrated, for example, in U.S. Pat. No. 3,134,158, the description of which is incorporated herein by reference.

SUMMARY OF THE INVENTION

It has been found that the bowing resulting from the "thermocouple" effect of the heat differential between the burner and manifold as occurs during operations of a singer may be greatly reduced through the use of dissimilar materials as between the burner and manifold so as to provide comparable characteristics within the operating temperature range. A reduction in deformation may also be achieved through the use of intermediate fuel pass-over or other control means for producing an integral assembly wherein stresses are evenly distributed between the members to afford bracing therebetween and the uniformity of the characteristics of the flame distribution is also enhanced.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a burner and manifold assembly for use in a fabric singer having fluid cooled backup rolls about which the fabric moves in open width for opening the interstices of the fabric for accessibility to flame therealong. The flame is delivered for impingement upon the fabric from a burner having a fuel supply manifold extending in substantial alignment therewith, and having means for bringing about a cessation of impingement of the flame upon the fabric when fabric movement is discontinued. A tubular cast iron burner A is carried horizontally transversely of the machine in substantial alignment with the backup rolls B for delivering a sheet of flame therealong for impinging directly upon the opened fabric moving about the backup rolls. A tubular manifold C is carried behind the tubular cast iron burner, remote from the flame so as to maintain a lower temperature during operation than does the cast iron burner, constructed from a material possessing a coefficient of expansion substantially compatible with the coefficient of expansion of the cast iron at operating temperatures. An end pass-through connector D is positioned adjacent each end of the burner and the manifold providing fuel and heat flow between the cast iron burner and the manifold. A plurality of additional spaced connector means are carried between the end connectors forming the burner and manifold assembly. Thus, heat and fuel are uniformly transferred between the burner and the manifold along the length thereof to minimize the bowing of the assembly by means of even heat distribution as well as to facilitate a uniform flame along the assembly.

Figure 1:
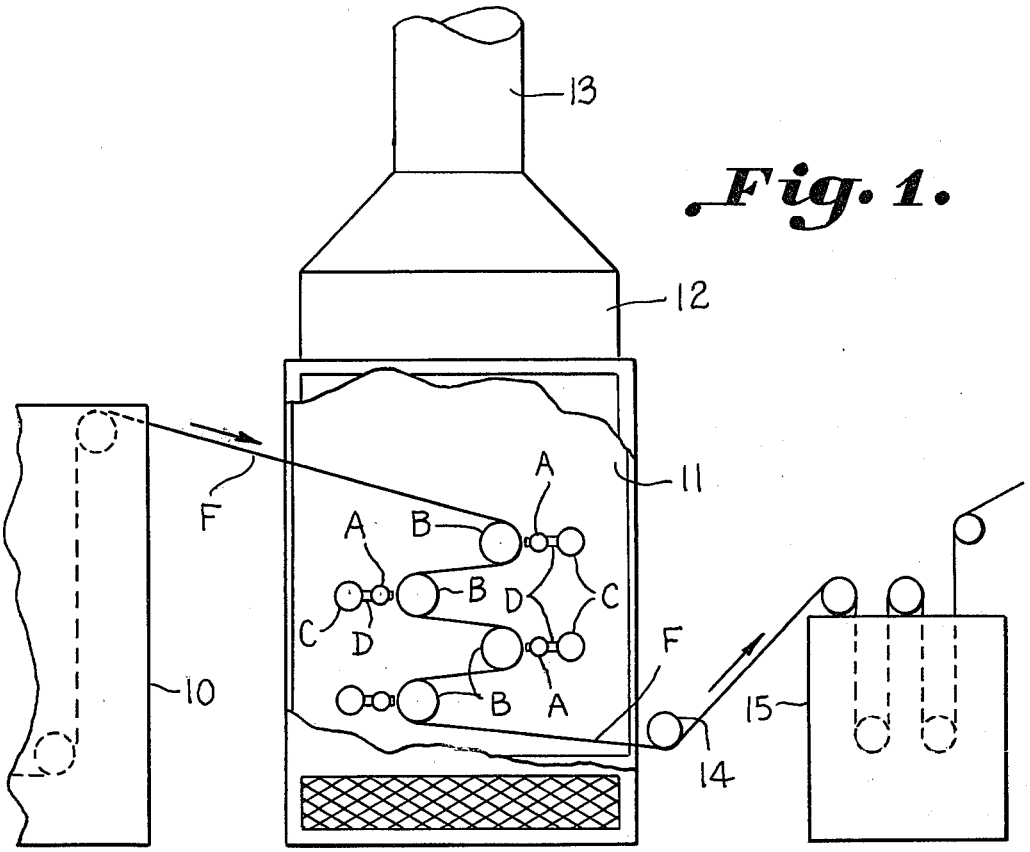
FIG. 1 is a schematic side elevation illustrating a singe and desize range wherein the singer is constructed in accordance with the present invention.

FIG. 1 schematically illustrates a singer constructed in accordance with the present invention being utilized in a singe and desize range. The fabric F is illustrated as being delivered from a brushing machine 10 to the singer. The singer is illustrated as including an end housing member 11 for supporting the various rolls and burner and manifold heat assembly therefor. Between the end frame members, an exhaust hood 12 having an exhaust duct 13 is mounted for removing gases and fumes generated during the singeing operation. The fabric F passes from the singer under a roll 14 and is illustrated as passing thence to a desize saturator 15 from whence the fabric may pass to a batcher and the like (not shown). If the singer is being otherwise utilized, as, for example, in a finish singe range, the fabric may pass to a brushing machine rather than the desizing saturator schematically illustrated.

Figure 2:
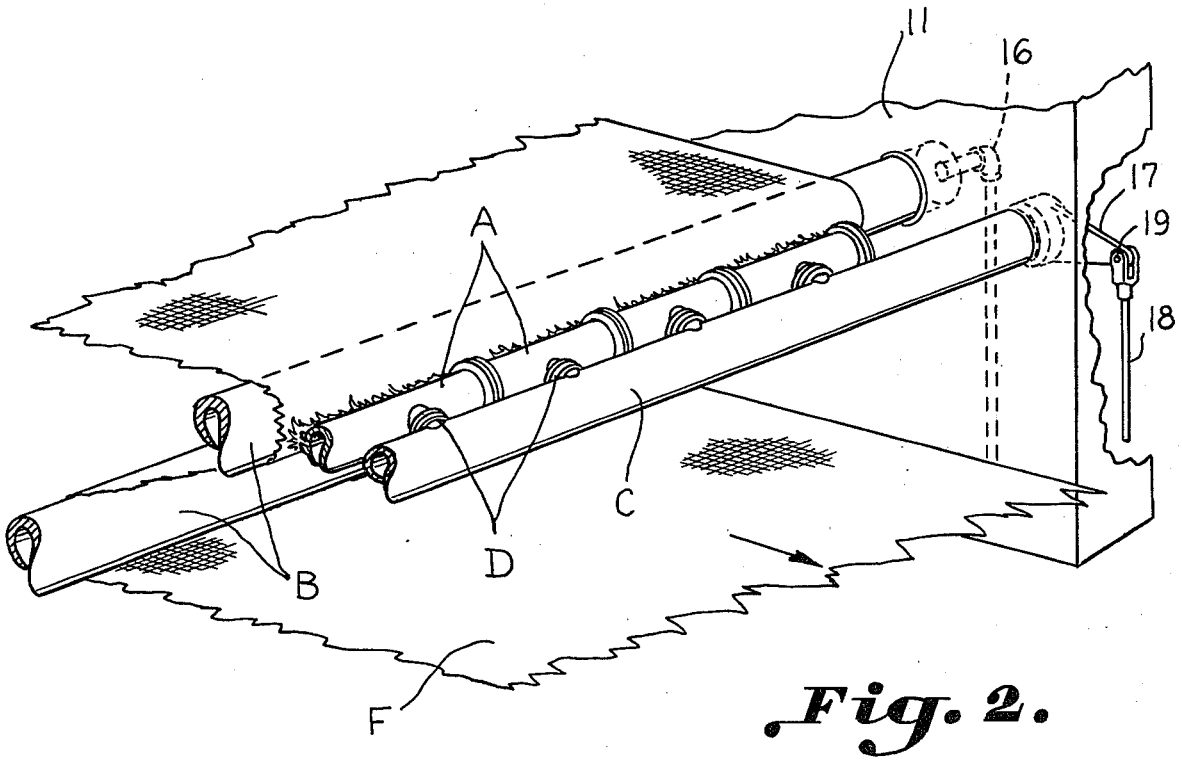
FIG. 2 is an enlarged front perspective view illustrating a burner and manifold assembly constructed in accordance with the present invention wherein the fabric is fed from the back of the machine over a water-cooled roll for a singeing operation preparatory to carrying out a final singeing operation and delivery of the cloth forwardly out of the machine.

Referring more particularly to FIGS. 1 and 2, the fabric F is illustrated as passing over water cooled rolls B whereon the interstices of the fabric are opened for impingement of flame thereon from the elongated burner member A. The water cooled rolls B are constructed in similar fashion to the water cooled rolls of U.S. Pat. No. 3,134,158 and the water is delivered thereto from the line 16 to flow therethrough when the temperature of the rolls reach a predetermined temperature so that the rolls are cooled continuously during the singeing operation and maintained within a predetermined temperature range by fluid flow.

The burner member A is illustrated as being rigidly secured to the manifold by spaced end and intermediate pass-through members D. The burner member A is carried for movement away from the fabric by means of the pivotal arrangement of the manifold C within the end housings or frame members 11. The end portion of the manifold C carried within the frame member or housing, has linkage means including an arm 17 attached thereto. The linkage means further includes an operating rod 18 pivotally secured as at 19 to the arm 17 and performing the function of directing any possible flame away from the fabric upon cessation of the operation of the device in similar fashion to that of the chain and sprocket illustrated in U.S. Pat. No. 3,134,158.

Figure 3:
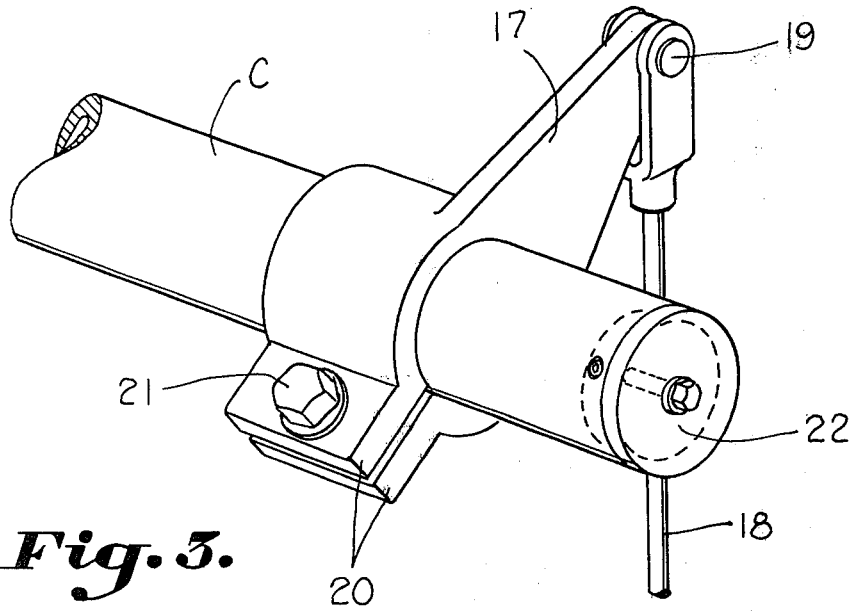
FIG. 3 is an enlarged perspective view further illustrating a manifold element constructed in accordance with the present invention with means for pivoting same together with the burner element carried thereby to direct the nozzle away from the cloth upon cessation of operation of the machine so that the flame is no longer directed against the cloth.

Referring more particularly to FIG. 3, the details of the linkage mechanism are further illustrated. The arm 17 has a clamping element 20 integral therewith which is fastened by the nut and bolt assembly 21 adjacent the end of the manifold C. The end of the manifold is illustrated as having a plug member 22 suitably secured therein.

Figure 4:
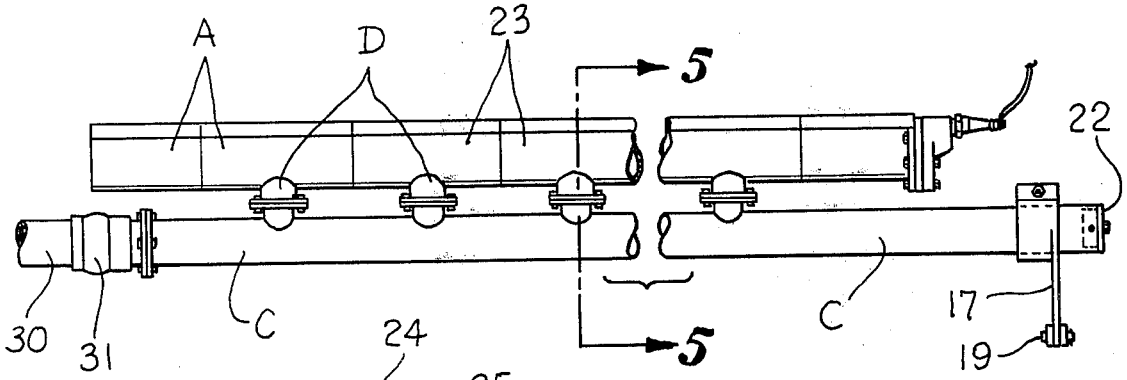
FIG. 4 is a plan view illustrating a burner and manifold assembly constructed in accordance with the present invention.
Figure 5:
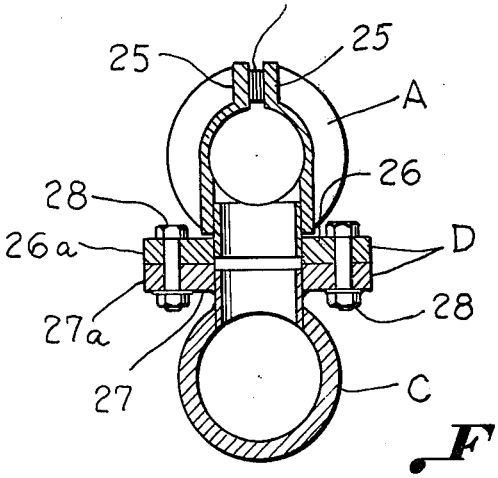
FIG. 5 is a transverse sectional elevation taken on the line 5—5 in FIG. 4 illustrating the diversity of materials of which the burner manifold elements are constructed to provide compatible expansion characteristics at operation temperatures to avoid bowing. The pass-through connector means are also illustrated in detail.

Referring more particularly to FIGS. 4 and 5, it will be observed that the burner A is of segmental construction having the segments 23 suitably joined to accommodate a metal ribbon member 24 acting as a nozzle to direct the flame for impingement upon the fabric. The nozzle of the burner A is further defined by the lips 25 between which the ribbon members are carried. The burner is illustrated as being constructed of cast iron and the like and a pass-through connector D is illustrated as having a coupling 26 suitably secured to the burner as by welding. The coupling 26 is constructed of material which is similar to that of the burner to facilitate welding. A complimentary fitting 27 is suitably fastened to the fitting 26 as by spaced bolts 28 which pass through opposed flat complimentary aligned flanges 26*a* and 27*a*. The tubular portion of the manifold C is illustrated as being constructed of a material having a compatible coefficient of expansion for producing comparable expansion characteristics as between the burner and manifold at operating temperatures. Such a compatible material for the manifold construction has been found to be aluminum where the usual cast iron and the like is used to construct the burner. The fitting 27 is constructed of similar material to that of the manifold to facilitate securement thereto as by welding. It will be observed that fuel is illustrated as being supplied to the manifold C as by a flange about connection 30 upon which fuel, in this case gas, may be fed through a suitable fitting 31 to the manifold for delivery through the pass-through connectors D to the burner A. Although it is preferred in each instance, the pass-through connector may not necessarily offer a passageway for the flow of gaseous fuel therethrough, and in some instances may simply provide a physical connection between the burner and manifold members.

As a result of experiments which have been carried out, it has been found that where the pass-through connectors offer unobstructed passage of heat from one element to the other, more even heating characteristics result which minimize the deformation of the assembly resulting in excessive bowing. Asbestos gaskets were placed between the fittings 26 and 27 and it was found that better results were achieved without them.

A table is set forth below illustrating that for an illustrative operating range of temperatures between about 700 degrees F. and 750 degrees F. for the burners with a corresponding operating temperature range of about 325 degrees F. to about 400 degrees F. in the manifold, that the expansion characteristics are similar where cast iron is used for the burner and aluminum is used for the manifold.

| | Linear Expansion per Unit Length For Metals From 68 Degrees F. | | | |
|---|---|---|---|---|
| | Aluminum | Brass | Cast Iron | Carbon Steel |
| 300° F. | .00289 | .00224 | .00152 | .00147 |
| 325° F. | .00320 | .00249 | .00168 | .00163 |
| 350° F. | .00351 | .00274 | .00185 | .00179 |
| 375° F. | .00382 | .00299 | .00201 | .00194 |
| 400° F. | .00413 | .00324 | .00217 | .00210 |
| 425° F. | .00444 | .00349 | .00234 | .00226 |
| 450° F. | .00475 | .00374 | .00250 | .00242 |
| 675° F. | .00756 | .00599 | .00398 | .00384 |
| 700° F. | .00786 | .00624 | .00414 | .00400 |
| 725° F. | .00817 | .00649 | .00430 | .00416 |
| 750° F. | .00848 | .00674 | .00447 | .00432 |
| 775° F. | .00880 | .00699 | .00463 | .00448 |
| 800° F. | .00911 | .00724 | .00479 | .00463 |

The corresponding operating temperature ranges for the several elements described above correspond generally to operating conditions obtaining singes of the type discussed herein. The differential in temperatures occurs due to the fact that the manifold is positioned behind and more remotely from the flame than is the burner which is best constructed from its usual cast iron material. The burners are illustrated as being arranged to cause flame impingement upon the fabrics at the roll center. Since the flame may be delivered substantially uniformly along the burner, an even singe occurs from side-to-side of the cloth. It has been found that additional bracing is not required to prevent excess bowing even on relatively wide singers.

While a preferred embodiment of the invention has been described using specific terms, such description is for illustrative purposes only, and it is to be understood that changes and variations may be made without departing from the spirit or scope of the following claims.

What I claim is:

1. A burner and manifold assembly for use in a fabric singer having fluid cooled fabric backup rolls about which the fabric moves in open width for opening the interstices of the fabric for accessibility to flame therealong from a burner having a fuel supply manifold extending in substantial alignment therewith, and having means for bring about a cessation of impingement of the flame upon the fabric when fabric movement is discontinued comprising:

a tubular cast iron burner carried horizontally transversely of the machine in substantial alignment with each of the backup rolls for delivering a sheet of flame therealong for impinging directly upon the opened fabric moving about the backup rolls;

a tubular manifold behind each said tubular cast iron burner, remote from said flame so as to maintain a lower temperature during operation than does said cast iron burner, constructed from a material possessing a coefficient of expansion resulting in expansion substantially compatible with the expansion of the cast iron at operating temperatures;

an end pass-through connector adjacent each end of said burner and said manifold providing fuel and heat flow between said cast iron burner and said manifold; and a plurality of additional spaced connector means between said end connectors forming the burner and manifold assembly;

whereby heat and fuel are uniformly transferred between said burner and said manifold along the length thereof to minimize the bow of the assembly through even heat distribution as well as to facilitate a uniform flame along the assembly.

2. The structure set forth in claim 1, wherein said manifold is constructed of aluminum.

3. The structure set forth in claim 2, wherein said end pass-through connectors and said additional spaced connector means each include a cast iron fitting welded to said burner and a complimentary aluminum fitting welded to said manifold and means securing said respective fittings together in integral joined relationship securing said assembly together.

* * * * *